US006102104A

United States Patent [19]

Sato

[11] Patent Number: 6,102,104

[45] Date of Patent: Aug. 15, 2000

[54] DIE-CUSHION OIL PRESSURE LOCKING DEVICE

[76] Inventor: Kazuo Sato, 4-28-14 Chuo, Sayama-Shi Saitama-Ken, Japan

[21] Appl. No.: 08/785,810

[22] Filed: Dec. 28, 1996

[51] Int. Cl.[7] ..... F24H 3/00

[52] U.S. Cl. ..... 165/47; 165/916; 165/95; 72/453.13

[58] Field of Search ..... 165/916, 95, 47; 72/453.13

[56] References Cited

U.S. PATENT DOCUMENTS

| | | | |
|---|---|---|---|
| 4,546,825 | 10/1985 | Melnyk et al. | 165/916 X |
| 4,773,357 | 9/1988 | Scharton et al. | 165/95 X |
| 5,048,596 | 9/1991 | Lu | 165/916 X |

FOREIGN PATENT DOCUMENTS

| | | | |
|---|---|---|---|
| 32224 | 7/1981 | European Pat. Off. | 165/916 X |
| 3084 | 1/1994 | Japan | 165/916 X |

*Primary Examiner*—Leonard Leo

[57] ABSTRACT

A die-cushion oil pressure locking device is composed of a locking cylinder which couples with the operation of the die-cushion device can be prevented the wrinkling when the mold products is processed, and an operating cylinder controls oil which is used in the operation of the locking cylinder; and a cooling oil cooler device made of stainless steel, being capable of falling down the increased-temperature oil which is discharged from the locking device body and regulated as to drop its pressure down in efficiency owing to provided the cooling oil cooler device having the inlet so that oil increased temperature through the locking device body passes through the off cooler tubes without the extra resistance in a durability at intermittent flow, and it is fallen down by a cooling water into the cooling device in a short time.

3 Claims, 7 Drawing Sheets

DIE-CUSHION OIL PRESSURE LOCKING DEVICE

BACKGROUND OF THE INVENTION

This invention relates generally to a die-cushion oil pressure locking device having an oil cooler device which can be fallen down the temperature of oil which is used by the press machine during operation.

The conventional die-cushion oil pressure locking device Z using in the press machine shown in FIGS. 6 and 7 is only done by falling down the outer wall of the locking device Y or the wall of the separated oil tank X.

Also, the designers have no idea about the using oil cooler device because the performance of durability has low level (in those day, the pressure limit of the oil cooler device is 10 kg/cm$^2$), and they had the recognition that it is not enough to cool it down of 20 to 40 litters inside the oil cooler device with one shot and the shot repeats from 6 to 8 times per minute. The air cooling device W including the ways to falling down the temperature of the wall of the oil tank X or the locking device Y needs 2,000 litters of oil so that they do not have enough performance, and their size become larger than that of the conventional one. In addition, vibration trouble comes out, and the load of the die-cushion wrinkle increases. Therefore, there was the trouble of the shortness of oil packing's life because the temperature of oil is above 60° C. (the oil temperature to up to about 120° C.).

SUMMARY OF THE INVENTION

Accordingly, among the several objects of the present invention are the provision of a die-cushion oil pressure locking device which is capable of being a simple construction; and the provision of such die-cushion oil pressure locking device which have an oil cooler device made of stainless which is capable of cooling in efficiency the oil used in the locking device.

DESCRIPTION OF THE PREFERRED EMBODIMENT

Figure 1:
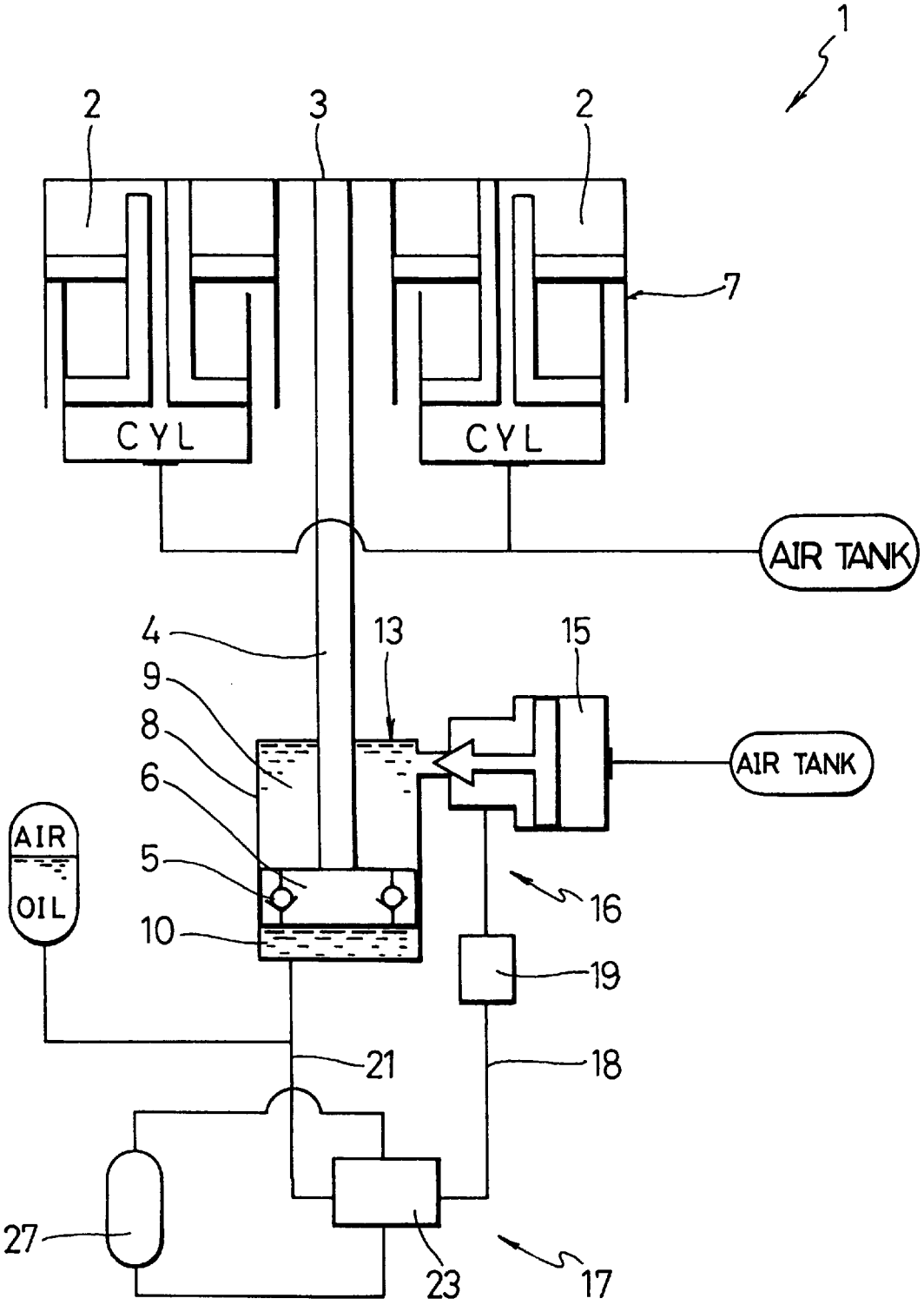
FIG. 1 is a block schematic diagram in use showing the first embodiment of the present invention.
Figure 2:
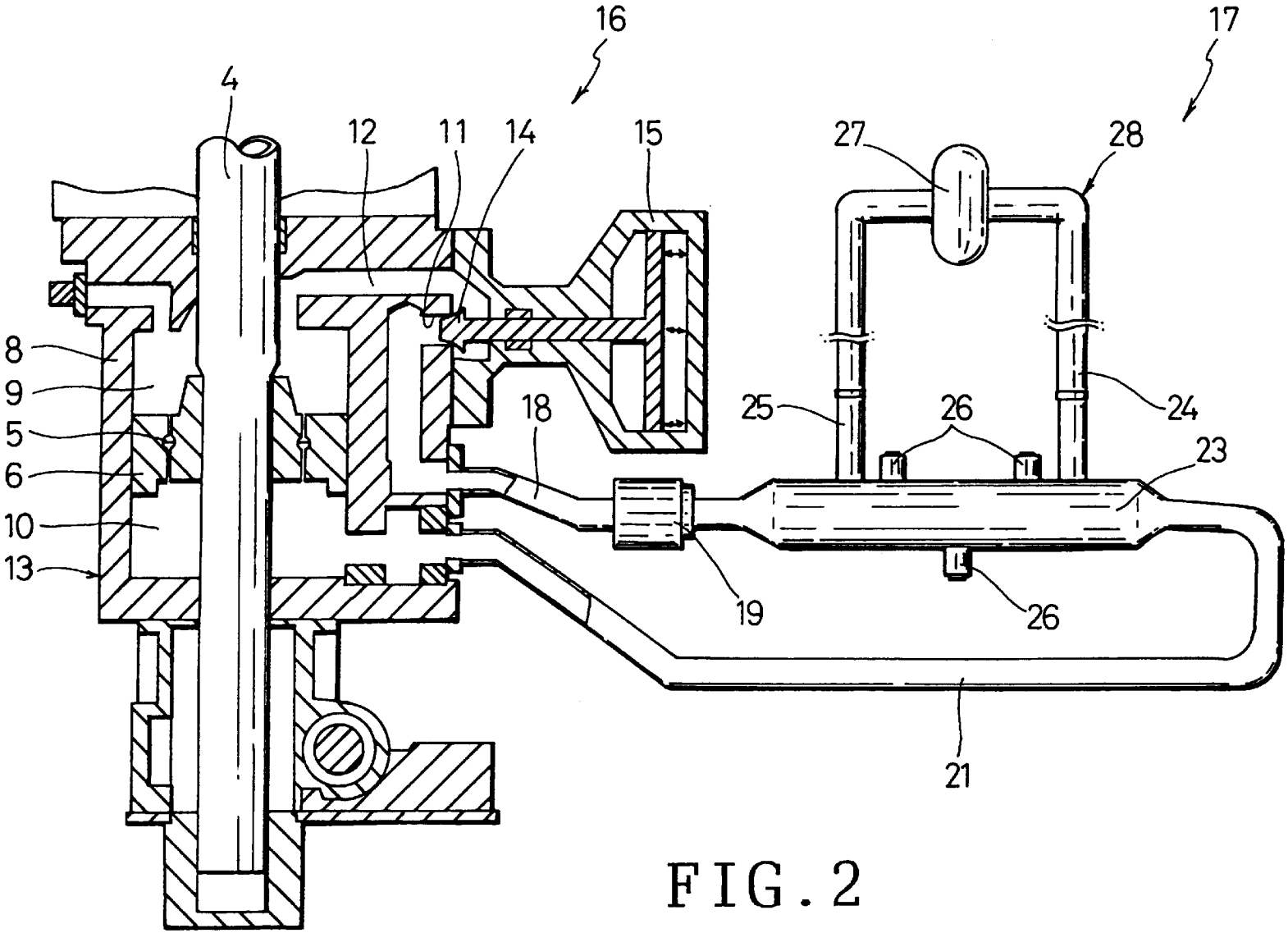
FIG. 2 is a partially sectional front view in use showing the first embodiment of the present invention.
Figure 3:
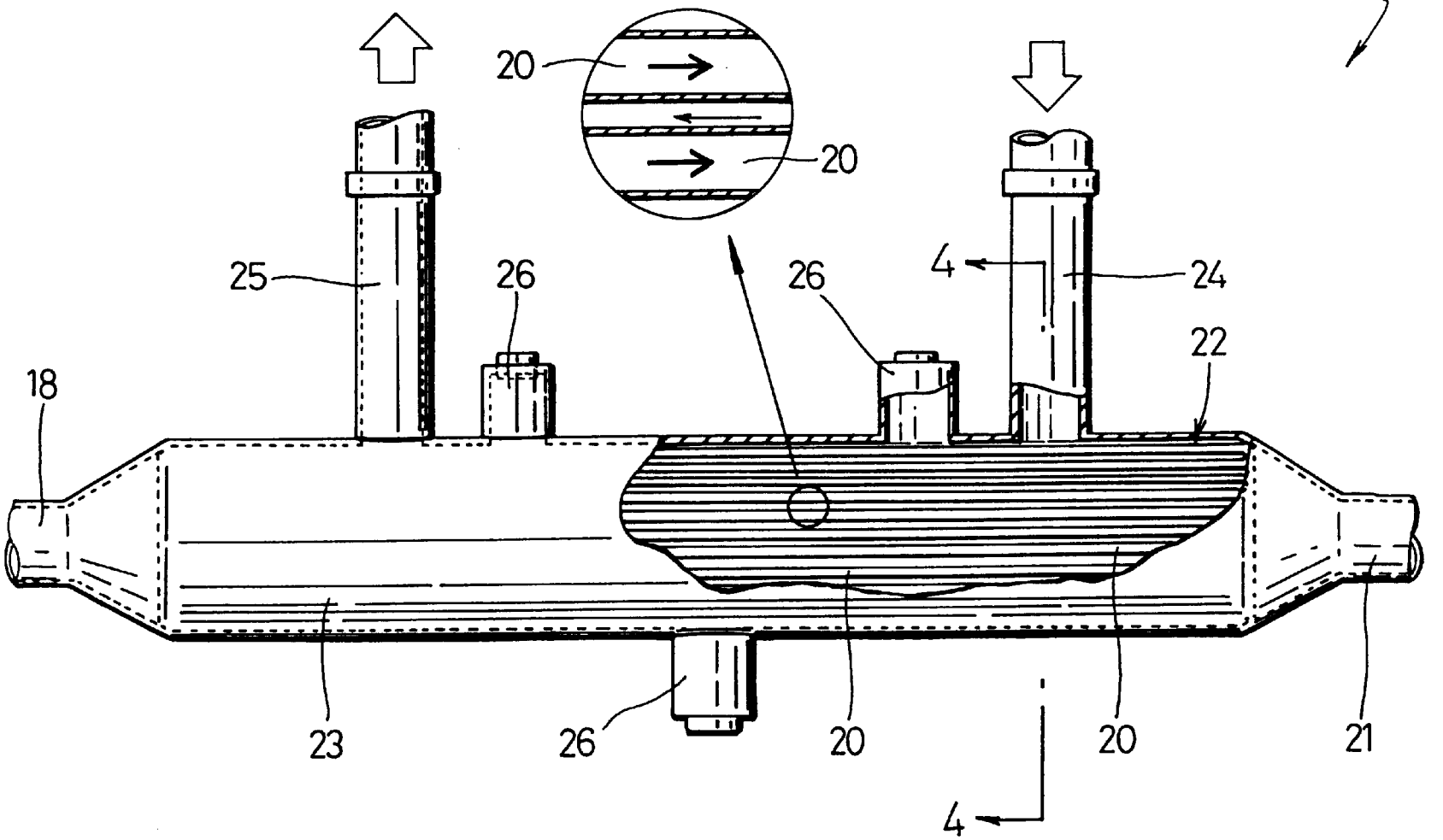
FIG. 3 is a partially sectional front view of oil cooling device.
Figure 4:
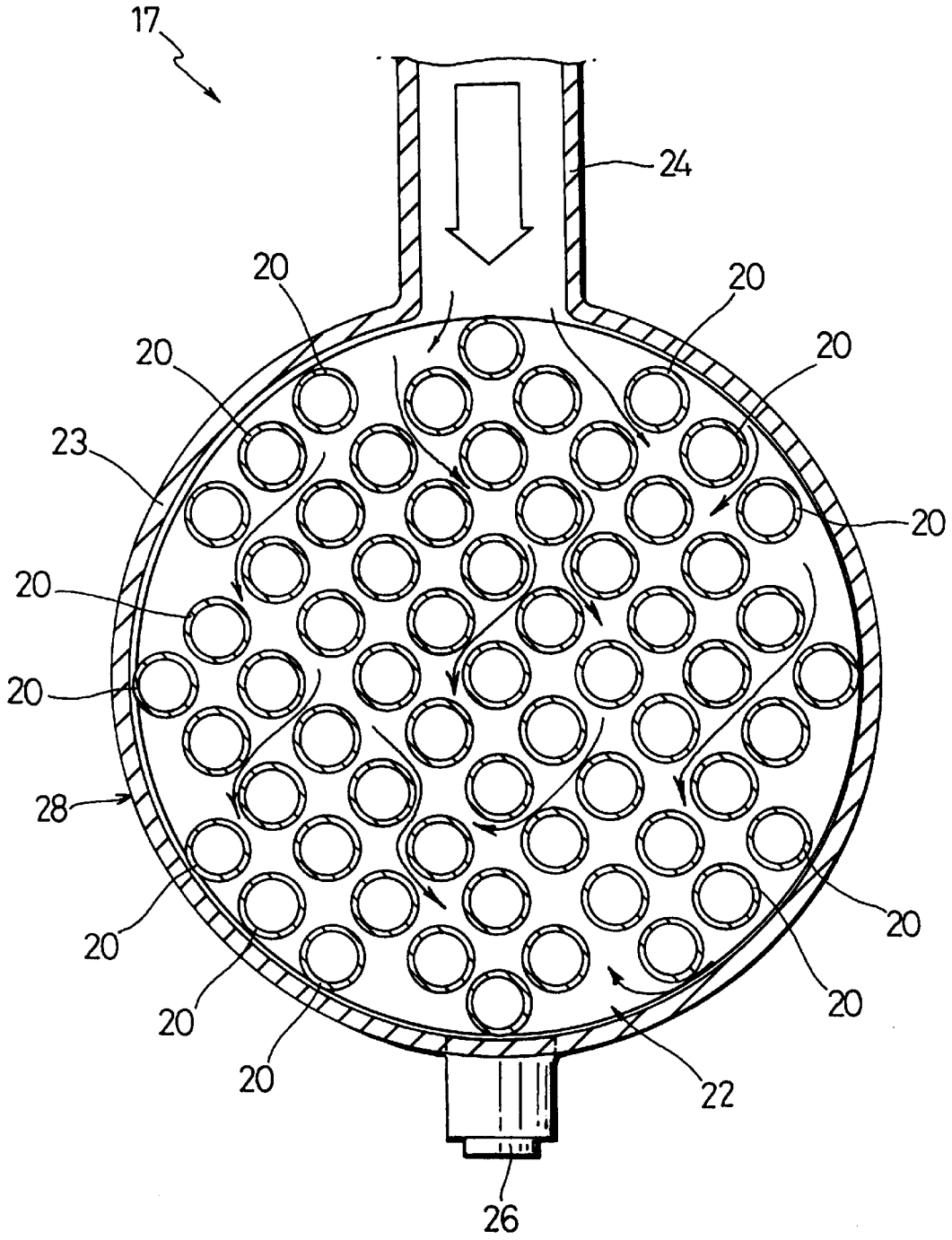
FIG. 4 is a cross-sectional view taken along the line 4–4 in FIG. 3.

Preferred embodiments of the present invention are described in more detail below referring to the accompanying drawings.

An understanding of the present invention may be best gained by reference the FIGS. 1 to 4. FIGS. 1 to 4 illustrate a die-cushion oil pressure locking device of the first embodiment of the present invention. The die-cushion oil pressure locking device 1 comprises a locking device body 16 attached to a die-cushion device 7 which is comprised of a die-cushion pad rod 4 having a die-cushion pad 3 at top portion thereof, being pushed up by compression air pressure of a pair of compressed air cabins 2, 2 and a locking cylinder piston 6 having a check valve 5 which can pass through oil therein, being formed at a lower part of the die-cushion pad rod 4 and an oil cooler device 17.

The locking device body 16 comprises a locking cylinder 13 which further comprises a locking cylinder body 8 which is formed so as to allow the locking cylinder piston 6 of the die-cushion device 7 to move upward and downward therein through oil setting the up and downward movement of the die-cushion pad rod 4; oil cabins 9,10 which move oil therein and can be stored therein to set the up-and-downward movement of the locking cylinder piston 6 into the locking cylinder body 18; an outlet tube 12 connected to the oil cabin 9 and discharges the stored oil into the oil cabin 9, the outlet tube 12 having an opening 11 formed at the approximately middle portion thereof and an operating cylinder 15 having an openable closure valve 14 which is formed so as to open and close the opening 11 of the outlet tube 12 of the locking cylinder 13.

The oil cooler device 17 comprises an oil cooler device body 22 and a cooling device 28.

In addition, the oil cooler device body 22 further comprises an oil tube 18 that connects to the outlet tube 12 and passes through the compressed oil therein when the opening 11 of the outlet tube 12 is opened by the openable closure valve 14; an oil flow regulator 19 attached to the oil tube 18 that regulates the oil flow of oil which is discharged from the oil cabin 9 horizontally and is fallen down the oil pressure; a plurality of oil cooler tubes 20 that are made of stainless steel and can with stand oil pressure up to 230 kg/cm$^2$, being connected to the oil tube 18, oil cooler tubes 20 can be flown the oil increased the temperature caused by falling down the pressure by the oil flow regulator 19 at intermittent pulse of 6 to 8 shots of the working period per minute; and an oil outlet tube 21 connected the plurality of oil cooler tubes with one end thereof, other end thereof is connected to the oil cabin 10 of the locking cylinder 13.

The cooling device 28 further comprises a tubular cooling device body 23 that is formed so as to pass through cooling water between oil cooler tubes 20 and an inner wall thereof and to fall down the oil increased the temperature; a cooling water inlet tube 24 connected to one side portion of the cooling device body 23 and can flow the cooling water to the cooling device body 23; a cooling water outlet tube 25 connected to another side portion of the cooling device body 23 and can discharge the cooling water from the cooling device body 23; cleaning plugs 26, three plugs in this embodiment, attached to the cooling device body 23, the cleaning plugs 26 being capable of cleaning an internal portion of the cooling device body 23; and a cooling tower 27 connected to ends of the inlet and outlet tubes 24, 25 and that can circulate the cooling water.

In the above referred die-cushion oil pressure locking device 1, when the die-cushion pad 3 falls down during processing the wrinkling, oil into the cabin 10 flows into the oil cabin 9 through the check valve 5 of the locking cylinder piston 6 as the locking cylinder piston 6 moves downward inside the locking cylinder 13. The oil into the rod flows to the oil tank.

In the flowing oil, just before reaching the bottom dead center, that is locking situation, of die cushion pad rod 4, the opening 11 of the outlet tube 12 is closed by the openable closure valve 14. As the movement with slide of the die cushion rod 4 goes through the bottom dead center and moves upward, the rising movement of the locking cylinder piston 6 coupled with the pushing up the die cushion pad 3 by the compressed air pressure of the compressed air cabin 2 is stopped while the locking cylinder piston 6 gives pressure to oil within the oil cabin 9, and the die cushion pad 3 is prevented to raise at a top dead center. Then, oil stored into the oil cabin 9 is confined to the pressure up to 60 to 70 $kg/cm^2$.

When it is the locking condition at the top dead center to lift, the pressurized oil within the oil cabin 9 is discharged through the outlet tube 12 and oil tube 18 after the opening 11 of the outlet tube 12 is opened by the openable closure valve 14 of the operating cylinder 15. When the pressurized oil is passed through the oil tube 18, this oil is regulated its fluid flow by the oil flow regulator 19 attached to the oil tube 18, and its pressure goes down and the regulated oil runs hot (30,000 to 40,000 kcal/h). In addition, the regulated oil is flowed to the plurality of oil cooler tubes 20 in an axial direction without the extra resistance to the inner wall portion of the oil tube 18 and the tube portion between the oil tube 18 and oil cooler tubes 20.

When oil increased temperature passes through the each of the oil cooler tubes 20, the oil has a fixed quantity (pressure, fluid flow) of pulse state and intermittent flow, then the oil pressure drops quickly from 60–70 $kg/cm^2$ to 1.2–1.5 $kg/cm^2$ at a movement so that the water hammer phenomenon presents repeatedly.

During the passing oil through the oil cooler tubes, since the oil cooler tubes 20 has the cooling device body 23 at outer circumferential part thereby, the cooling water through the cooling water inlet tube 24 flows the space between the outer part of the oil cooler tubes 20 and inner surface part of the cooling device body 23, the generated heat of oil is absorbed by cooling water, and it can be controlled and is cooled to 30 to 35° C., that is, it becomes the best temperature in operation. After that, the oil increased the temperature passes through the oil outlet tube 21 and back to the oil cabin 10 of the locking cylinder 13 as the cooling water within the cooling device body 23 is discharged to pass through the cooling water outlet tube 25, and it returns to the cooling tower 27.

Also, if the die-cushion oil pressure locking device 1 is attached to a big press machine, the die-cushion rising stroke control mechanism will be attached, and the mechanism and its maintenance become to advantage.

Other embodiment of the present invention will now be described referring to FIG. 5. Throughout the drawing of the embodiment, like components are denoted by like numerals a of the first embodiment and will not therefore be explained in greater detail.

Figure 5:
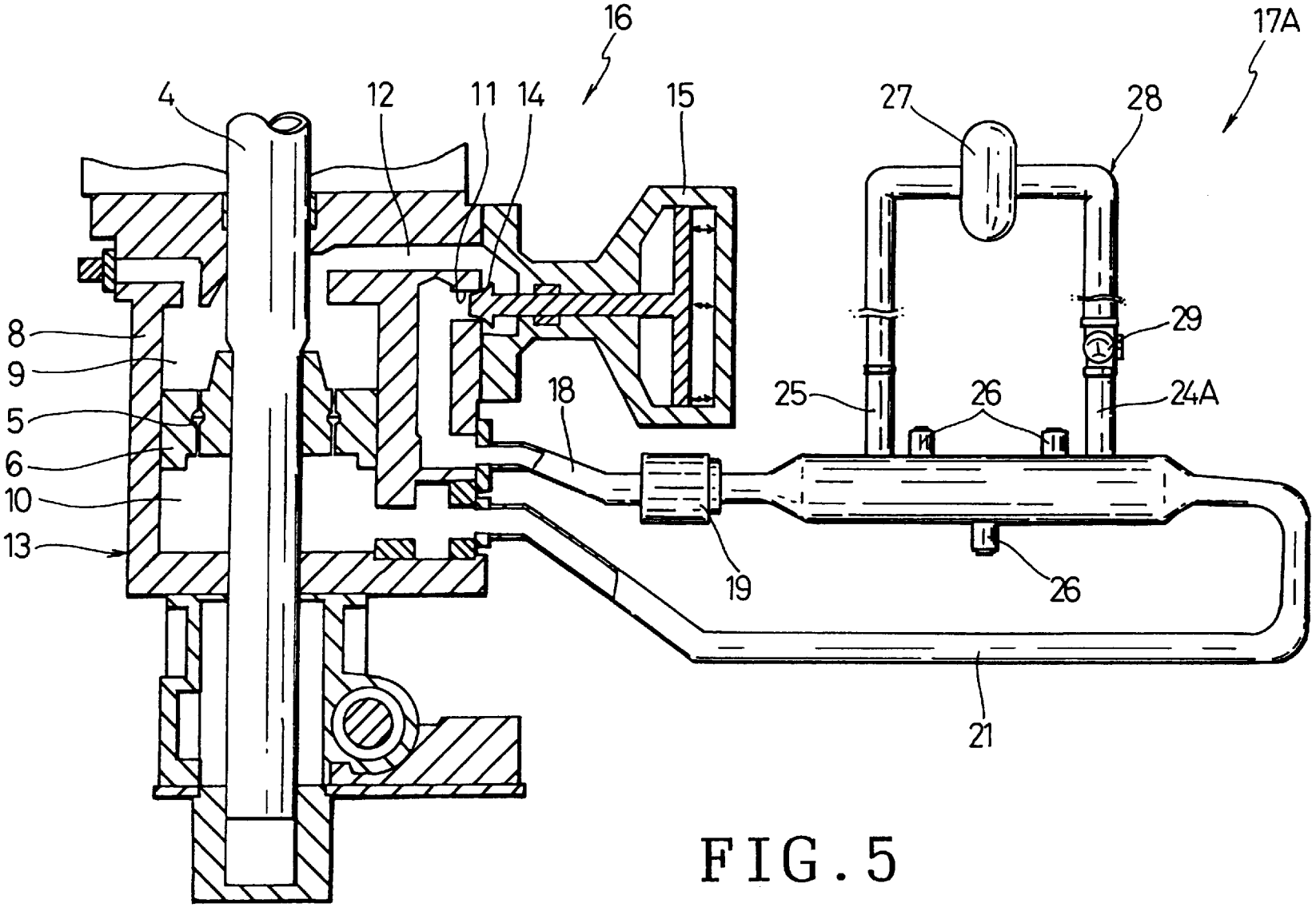
FIG. 5 is an expanded explanation view showing the second embodiment of the present invention.
Figure 6:
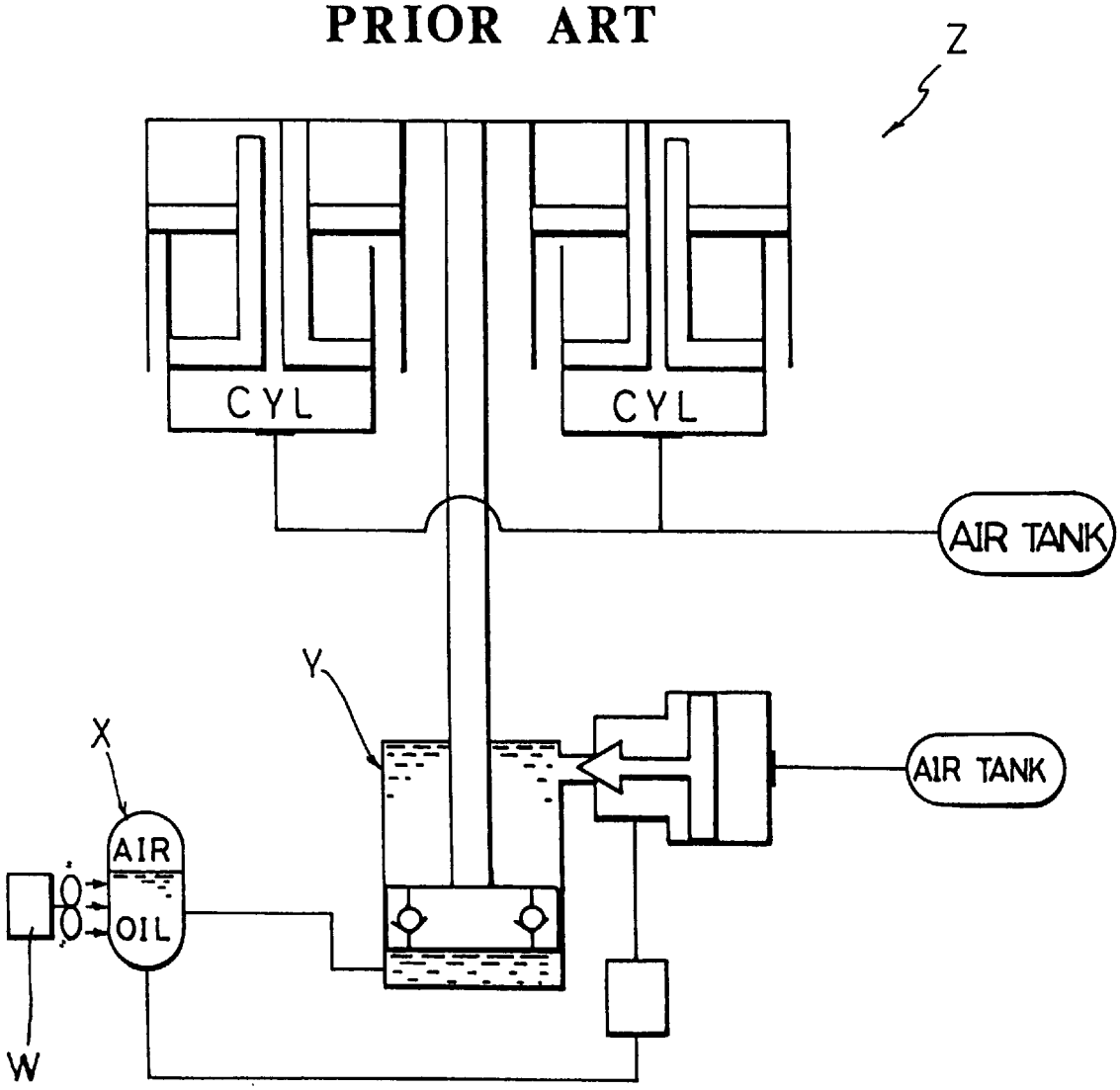
FIG. 6 PRIOR ART
FIG. 6 is a prior view of the die-cushion locking device having the air cooling device.
Figure 7:
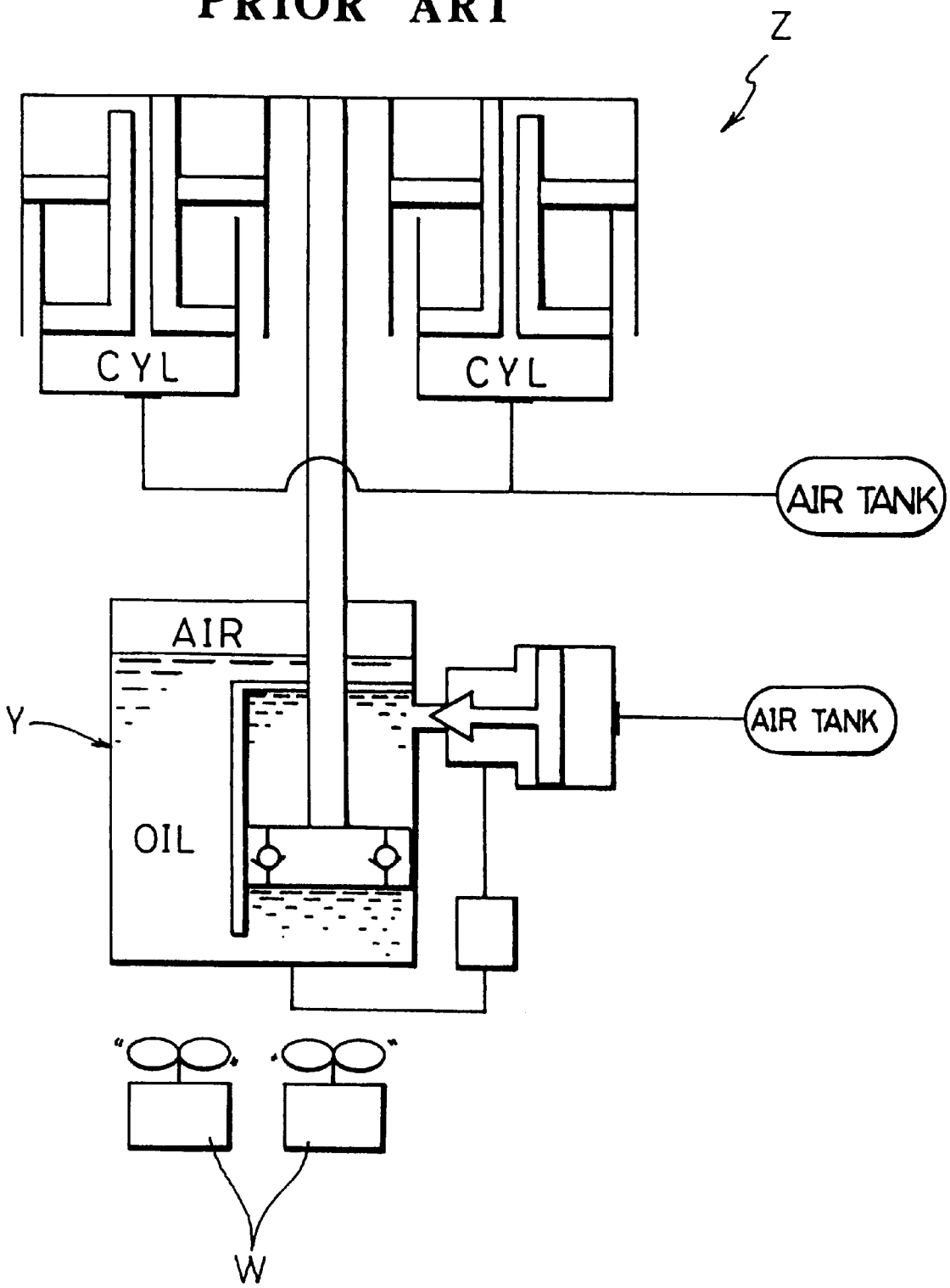
FIG. 7 PRIOR ART
FIG. 7 is a other prior view of the die-cushion locking device having the air cooling device.

FIG. 5 illustrates the second embodiment of the present invention which is distinguished from the first embodiment by the fact that the cooling oil cooler device 17 is replaced from another like device 17A. The cooling oil cooler device 17A includes a cooling water flow tube 24A having a cooling water flow regulator 29 which is capable of regulating the fluid delivery rate for the cooling water to the cooling device body 23. Accordingly, a die-cushion oil pressure locking device 1A with the cooling oil cooler device 17A according to the second embodiment will provide the same function as of the first embodiment.

As set forth above, the advantages of the present invention are as follows:

(1) A die-cushion oil pressure locking device is composed of:

a locking device body further comprises a locking cylinder including a locking cylinder body which can be prevented the wrinkling when the molded product is processed, the locking cylinder body being formed so as to store oil and flow it therein and being coupled with a die-cushion device operated by a compressed air and an outlet tube attached to the locking cylinder body, having an opening thereof; and an operating cylinder attached to an outer wall of the locking cylinder, having an openable closure valve which can open and close the opening of the outlet tube, so as to discharge an oil from the locking cylinder and pressurize the oil into the locking cylinder at a compressed condition;

a cooling oil cooler device made of stainless steel, one end portion thereof being connected the outlet tube, another end portion thereof being connected locking cylinder body, said cooling oil cooler device being capable of regulating the fluid flow of the, oil discharged from the locking cylinder body when said openable closure valve is opened, allowed the temperature of regulated oil to fall down by a cooling water, and flowed cooled oil in an axle direction in a condition that the resistance decreases to flow;

the oil cooler device body which further including an oil tube passes through the discharged oil when the opening of the outlet tube is opened by the openable closure valve and extending horizontally; an oil flow regulator attached to said oil tube, regulating the oil flow; a plurality of oil cooler tubes that are made of stainless steel, the oil cooler tubes being connected to said oil tube horizontally and having an inlet and outlet thereof in a straight direction such that said oil cooler tubes can be flowed oil regulated by said oil flow regulator at an intermittent drop manner in an axial direction in such condition that the resistance decreases to flow; and an oil outlet tube connected said plurality of oil cooler tubes, one end thereof being connected to the oil cooler tubes horizontally, other end thereof being connected to said oil cabin of said locking cylinder; and the cooling device which further including a cooling device body which is formed such that the cooling device body is located at an outer circumferential portion of said plurality of oil cooler tubes, so as to pass a cooling water through spaces among said oil cooler tubes into said cooling device body; and a cooling water inlet tube and a cooling water outlet tube which are connected to said cooling device body and a cooling tower connected to said cooling water inlet tube and cooling water outlet tubes such that it is allowed the cooling water to circular.

Therefore, it is easy to pass through the pressed oil easily without the extra resistance because the cooling oil cooler device is made of stainless steel material in an axial direction horizontally.

Furthermore, it avoids potential problems such as unsteadiness during use by the water hammer phenomenon and being broken itself.

(2) According to the teaching of the paragraph (1), the cooling oil cooler device can fall down the temperature of oil in efficiency in a short time so that the volume of oil can be decreased easily in operation.

Therefore, the size of the device can be reduced. Additionally, it can be set up in a small space.

(3) According to the teaching of the paragraph (1), the cooling oil cooler device can fall down the temperature of oil in efficiency so that it can be prevented to worsen the quality of oil.

Therefore, the fixtures such as seal can be used in economical for a long time.

(4) According to the teaching of the paragraph (1), the die-cushion oil pressure locking device is simple in structure and will be fabricated with ease and less cost.

(5) According to the teaching of the paragraph (1), the pressurized oil drawn from the die-cushion oil pressure locking device can be flowed in a straight direction through the plurality of cooling tubes and drawn from the outlet in a horizontal direction, so that the oil flow with less resistance can be flowed smoothly.

(6) According to the teaching of the paragraph (1), oil cooler device has a plurality of oil cooler tubes so that it has a large area of contacting surface to the cooling water and the temperature of the intermittent oil flow passed through the oil cooler tubes can be fallen it down in efficiency.

Therefore, there is no reserve tank to store the large amount of oil for die-cushion oil pressure locking device.

(7) Claim 2 has the same effects of the above mentioned paragraphs (1) to (6) and the cooling water inlet tube includes a cooling water flow regulator which can regulate the fluid flow of the cooling water so that it is easy to apply to its changes even if the temperature of oil changes suddenly.

What is claimed is:

1. A die-cushion oil pressure locking device comprising:

a locking device body further comprises a locking cylinder including a locking cylinder body which can be prevented the wrinkling when the molded product is processed, the locking cylinder body being formed such that the locking cylinder body stores oil therein and drain it while the locking cylinder body couples with a die-cushion device which is operated by a compressed air and an outlet tube attached to the locking cylinder body, having an opening thereof; and an operating cylinder attached to an outer wall of the locking cylinder, having an openable closure valve which can open and close the opening of the outlet tube so as to discharge an oil from the locking cylinder and pressurize the oil into the locking cylinder at a pressurized condition;

a cooling oil cooler device made of stainless steel, one end portion thereof being connected the outlet tube, another end portion thereof being connected the locking cylinder body, said cooling oil cooler device being capable of regulating the fluid flow of oil discharged from the locking cylinder body when said openable closure valve is opened, allowed the temperature of the regulated oil to fall down by cooling water, and flowed cooled-oil in an axial direction in a condition that the resistance decreases to flow;

the oil cooler device body which further including an oil tube passes through the discharged oil when the opening of the outlet tube is opened by the openable closure valve and extending horizontally; an oil flow regulator attached to said oil tube, regulating the oil flow; a plurality of oil cooler tubes that are made of stainless steel, the oil cooler tubes being connected to said oil tube horizontally and having an inlet and outlet thereof in a straight direction such that said oil cooler tubes can be flowed the oil regulated by said oil flow regulator at an intermittent drop manner in an axial direction in such a condition that the resistance decreases to flow; and an oil outlet tube connected said plurality of oil cooler tubes, one end thereof being connected to the oil cooler tubes horizontally, other end thereof being connected to said oil cabin of said locking cylinder; and the cooling device which further including a cooling device body which is formed such that the cooling device body is located at an outer circumferential portion of said plurality of oil cooler tubes, so as to pass a cooling water through spaces among said oil cooler tubes into said cooling device body; and a cooling water inlet tube and a cooling water outlet tube which are connected to said cooling device body and a cooling tower connected to said cooling water inlet tube and cooling water outlet tubes such that it is allowed the cooling water to circulate.

2. The die-cushion oil pressure locking device according to claim 1, wherein said cooling oil cooler device further including a cooling water flow regulator provided to said cooling water inlet tube of the cooling device body, the cooling water flow regulator regulating the fluid flow of the cooling water adjusting the temperature of oil; and cleaning plugs provided to said cooling device body, the cleaning plugs being utilized during in cleaning in said cooling drive body, and being capable of drawn treatment water out.

3. The die-cushion oil pressure locking device according to claim 1, wherein said cooling oil cooler device further including a regulator provided to said cooling water inlet tube of the cooling device body, the cooling water flow regulator regulating the fluid flow of the cooling water adjusting the temperature of oil.

* * * * *